US007018027B2

(12) United States Patent
Harada et al.

(10) Patent No.: US 7,018,027 B2
(45) Date of Patent: Mar. 28, 2006

(54) INKJET RECORDING APPARATUS AND INK CARTRIDGE

(75) Inventors: Kazumasa Harada, Nagano (JP); Kazuhiro Hashii, Nagano (JP); Atsuhiko Takeuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/462,942

(22) Filed: Jun. 17, 2003

(65) Prior Publication Data

US 2004/0021737 A1 Feb. 5, 2004

(30) Foreign Application Priority Data

Jun. 17, 2002 (JP) ..... P2002-175691
Jun. 13, 2003 (JP) ..... P2003-168570

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS

| | | | |
|---|---|---|---|
| 4,277,791 | A | 7/1981 | Rosenstock et al. |
| 5,642,143 | A | 6/1997 | Rhoads |
| 5,699,091 | A | 12/1997 | Bullock et al. |
| 5,805,187 | A | 9/1998 | Sasaki |
| 5,949,459 | A | 9/1999 | Gasvoda et al. |
| 6,250,750 | B1 | 6/2001 | Miyazawa et al. |
| 6,290,332 | B1 | 9/2001 | Crystal et al. |
| 6,402,298 | B1 * | 6/2002 | Nanjo et al. ..... 347/49 |
| 6,431,681 | B1 | 8/2002 | Hatasa et al. |
| 6,502,917 | B1 | 1/2003 | Shinada et al. |
| 2002/0071011 | A1 | 6/2002 | Hayashi et al. |
| 2002/0085075 | A1 | 7/2002 | Shinada et al. |
| 2002/0196312 | A1 | 12/2002 | Ishizawa et al. |
| 2005/0036015 | A1 | 2/2005 | Seino et al. |

FOREIGN PATENT DOCUMENTS

| | | |
|---|---|---|
| DE | 28 12 562 A1 | 9/1979 |
| EP | 0 829 363 A2 | 3/1998 |
| EP | 0 997 297 A1 | 5/2000 |
| EP | 1 000 749 A2 | 5/2000 |
| EP | 1 122 076 A1 | 8/2001 |
| EP | 1 177 904 A1 | 2/2002 |

(Continued)

OTHER PUBLICATIONS

Search and Examination Report from British Pat. Appln. 0314056.3 (Nov. 26, 2003).

(Continued)

*Primary Examiner*—Thinh Nguyen
(74) *Attorney, Agent, or Firm*—Stroock & Stroock & Lavan LLP

(57) ABSTRACT

There is disclosed an ink cartridge capable of being removably held in an ink cartridge accommodation portion simply by pushing in the cartridge in an insertion direction. The ink cartridge (5) is mounted on a carriage (4) having a cartridge accommodation region. A one-push type fixing member (30) in a position facing a surface parallel to an insertion direction in which the cartridge is inserted into the cartridge accommodation region is engaged with a fixing protrusion (12*a*) forming another one-push type fixing member and cooperating with the first-mentioned one-push type fixing member, so that the cartridge (5) is held in a predetermined position in a state in which the cartridge is resiliently urged by a spring (24) in a direction opposite to the insertion direction.

19 Claims, 11 Drawing Sheets

FOREIGN PATENT DOCUMENTS

| | | | |
|---|---|---|---|
| EP | 1 199 179 | A1 | 4/2002 |
| EP | 1 213 148 | A1 | 6/2002 |
| EP | 1 323 533 | A2 | 7/2003 |
| GB | 2 241 201 | | 8/1991 |
| GB | 2 315 045 | A | 1/1998 |
| GB | 2 321 623 | A | 8/1998 |
| GB | 2 343 145 | A | 5/2000 |
| GB | 2 387 567 | | 10/2003 |
| GB | 2 391 200 | | 4/2004 |
| JP | 1-141750 | A | 6/1989 |
| JP | 09-11500 | A | 1/1997 |
| JP | 9-123479 | | 5/1997 |
| JP | 9-309213 | | 12/1997 |
| JP | 10-109427 | | 4/1998 |
| JP | 10-235888 | A | 9/1998 |
| JP | 2001-277541 | | 10/2001 |
| JP | 2002-19135 | | 1/2002 |
| JP | 2002-254673 | | 9/2002 |
| WO | WO 99/59823 | | 11/1999 |
| WO | WO99/59823 | | 11/1999 |
| WO | WO-01/49499 | A1 | 7/2001 |

OTHER PUBLICATIONS

European Search Report (Appln. 03 01 3365.6).
Preliminary Search Report dated Aug. 2, 2004 in French Patent Appln. No. 0307263.
U.S. Appl. No. 10/912,885, filed Aug. 6, 2004, Kimura et al.
U.S. Appl. No. 11/026,191, filed Dec. 30, 2004, Harada et al.
U.S. Appl. No. 11/026,109, filed Dec. 30, 2004, Seino et al.
U.S. Appl. No. 10/912,885, filed Aug. 6, 2004, Kimura et al.
Combined Search and Examinaiton Report in British appln. No. GB 0424553.6, dated Feb. 1, 2005.

* cited by examiner

INKJET RECORDING APPARATUS AND INK CARTRIDGE

BACKGROUND OF THE INVENTION

1. Field of the Invention

The present invention relates to an inkjet recording apparatus fitted with a recording head for ejecting droplets of ink onto a recording medium in response to a print signal and also to an ink cartridge used in this inkjet recording apparatus.

2. Description of the Related Art

An inkjet recording apparatus has a recording head for ejecting droplets of ink. This head is mounted on a carriage that reciprocates relative to a recording medium. The recording apparatus currently available is so designed that ink is supplied to the recording head from an ink cartridge via an ink channel such as a tube or that ink is supplied to the recording head via an ink supply needle formed on the carriage where an ink cartridge is mounted.

Either of these types employs an arrangement in which an ink leading-out member, such as the ink supply needle, of the main body side is inserted into or connected to an ink supply port of the ink cartridge, and therefore the ink cartridge and the ink leading-out member must be reliably connected and fixed to each other so as to avoid an unintentional disconnection therebetween. To this end, it is necessary to provide a member for fixing the ink cartridge to the cartridge accommodation portion in the related art.

The arrangement using the aforementioned fixing member, however, requires two operations, i.e. mounting an ink supply port of the ink cartridge to a coupling member formed at an end of the ink supply path, and thereafter fixing the cartridge by the fixing member. Consequently, the sequence of operations for mounting is cumbersome to perform. Further, the fixing member is required to make the structure complicated.

SUMMARY OF THE INVENTION

In view of these problems, the present invention has been made. It is an object of the present invention to provide an inkjet recording apparatus permitting an inkjet cartridge to be fixed to an ink cartridge accommodation portion simply by pushing-in the ink cartridge in the mounting direction.

It is another object of the invention to provide an ink cartridge adapted for the recording apparatus described above.

To solve these problems, an inkjet recording apparatus according to the present invention as claimed in claim 1 is so designed that ink is supplied to a recording head from an ink cartridge mounted in a cartridge accommodation region. The ink cartridge has a first member constituting a one-push type fixing member that is formed on the ink cartridge. The inkjet recording apparatus has a second member that constitutes another one-push type fixing member cooperating with the first member and that is formed in a position facing a plane substantially parallel to an insertion direction in which the ink cartridge is inserted into the cartridge accommodation region, whereby the cartridge is held in a predetermined position in a state in which the ink cartridge is resiliently urged by resiliently urging member in a direction opposite to the insertion.

The inkjet recording apparatus according to the present invention as claimed in claim 3 is designed so that the resiliently urging member includes a spring that biases a valve body loaded in an ink supply port.

The inkjet recording apparatus according to;the present invention as claimed in claim 5 is designed so that a position of the holding portion or a diameter of the protrusion is selected to define a clearance between a dead point at pushing-in of the ink cartridge and the predetermined position.

An ink cartridge according to the present invention as claimed in claim 6 has an ink storing portion storing ink therein and an ink supply port communicating with the ink storing portion, and is adapted to removably mounted on a cartridge mounting portion of a recording apparatus to supply the ink in the ink storing portion via the ink supply port to a recording head provided on the recording apparatus. The ink cartridge includes: a first member that constitutes a one-push type fixing member, that is formed on a plane substantially parallel to an insertion direction in which the ink cartridge is inserted into the cartridge mounting portion, and that cooperates with a second member constituting another one-push type fixing member of the recording apparatus.

The ink cartridge according to the present invention as claimed in claim 7 is designed so that the second member includes a protrusion whose range of motion is restricted, and the first member includes a combination of a guide path for guiding the protrusion in one direction, and a holding portion engaging the protrusion.

The ink cartridge according to the present invention as claimed in claim 10 is designed so that the resiliently urging member includes a spring that biases a valve member loaded in the ink supply port.

The ink cartridge according to the present invention as claimed in claim 12 is designed so that the first member is disposed on a wall surface intersecting a wall surface on which the ink supply port is disposed, and located at a position offset toward the wall surface on which the ink supply port is disposed.

The ink cartridge according to the present invention as claimed in claim 13 is designed so that the ink supply port is located at a position offset toward the wall surface on which the first member is disposed.

The ink cartridge according to the present invention as claimed in claim 14 is designed so that the protrusion whose range of motion is restricted is movable in a plane direction of the plane substantially parallel to the insertion direction, and also movable in a direction intersecting the plane.

The ink cartridge according to the present invention as claimed in claim 15 is designed so that the holding portion of the first member is resiliently held by the protrusion by an urging force of resiliently urging member.

The ink cartridge according to the present invention as claimed in claim 16 is designed so that a position of the holding portion or a diameter of the protrusion is selected to define a clearance between a dead point at pushing-in of the ink cartridge and the predetermined position.

According to the present invention as claimed in claim 1 (claim 6), when the cartridge is mounted, the ink cartridge is pushed-in against the resiliently urging member, so that the cartridge is held in the predetermined position by the action of the one-push type fixing members and the biasing force of the resiliently urging member. When the ink cartridge is detached, the ink cartridge is pushed-in against the biasing force. This disengages the one-push type fixing members, and therefore the ink cartridge is moved in the removing direction opposite to the insertion direction, by the biasing force.

Therefore, when the cartridge is installed, the ink cartridge can be held into a predetermined position simply by pushing in the cartridge against a resilient member. Furthermore, the ink cartridge can be disengaged by pushing it in against the biasing force, so that the cartridge can be moved in the removing direction by the biasing force. Moreover, a fixing member such as a cover member for fixing the cartridge to the cartridge accommodation region can be dispensed with, and further the ink cartridge can be easily taken out.

According to the present invention as claimed in claim 3 (claim 10), a simplified structure can be realized because an additional member, i.e. a spring, for biasing the ink cartridge is unnecessary.

According to the present invention as claimed in claim 5 (claim 16), owing to the clearance between the dead point and the holding position, the packing of the ink supply port can be reliably brought into close contact with the ink supply needle to improve the air tightness. Further ink can flow in between the packing and the ink supply needle during the removal to reduce the friction, so that the ink cartridge can be surely taken out only by the stored force of the resiliently urging member. According to the present invention as claimed in claim 7, it is unnecessary to dispose, on the ink cartridge side, a movable member for fixing the ink cartridge to the carriage, and further the arrangement can be realized simply by forming protruded and recessed portions on the wall surface. Therefore, the structure and the package can be simplified.

According to the present invention as claimed in any one of claims 12 to 15, the region as close to the ink supply port as possible can be used as a holding region of the ink cartridge, and therefore it is possible to eliminate the displacement of the ink cartridge caused by an external force, and to reduce an adverse effect on the joint portion between the ink supply port and the ink supply needle.

The present disclosure relates to the subject matter contained in Japanese patent applications having No. 2002-175691 (filed on Jun. 17, 2002), and a not-yet-known number (filed on Jun. 13, 2003), which are expressly incorporated herein by reference in their entireties.

DESCRIPTION OF THE PREFERRED EMBODIMENT

The present invention is hereinafter described in detail with reference to the illustrated embodiments.

Figure 1:
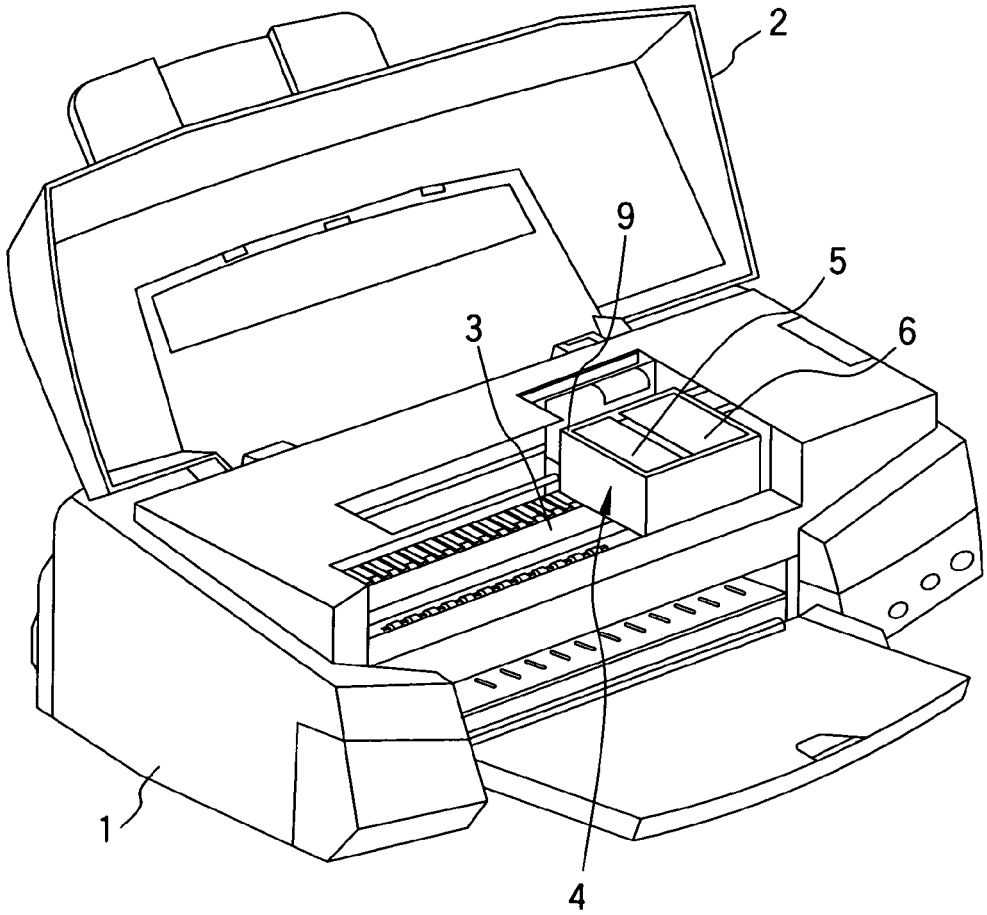
FIG. 1 is a perspective view showing an embodiment of an inkjet recording apparatus of the present invention.

FIG. 1 shows an embodiment of an inkjet recording apparatus of the present invention. A case is made up of a case body 1 and a cover 2. A carriage 4 is accommodated in the case to be opposed to a platen 3 and to be reciprocatingly movable. Two kinds of ink cartridges 5 and 6 having different widths are detachably mounted on the top surface of the carriage 4.

Figure 2:
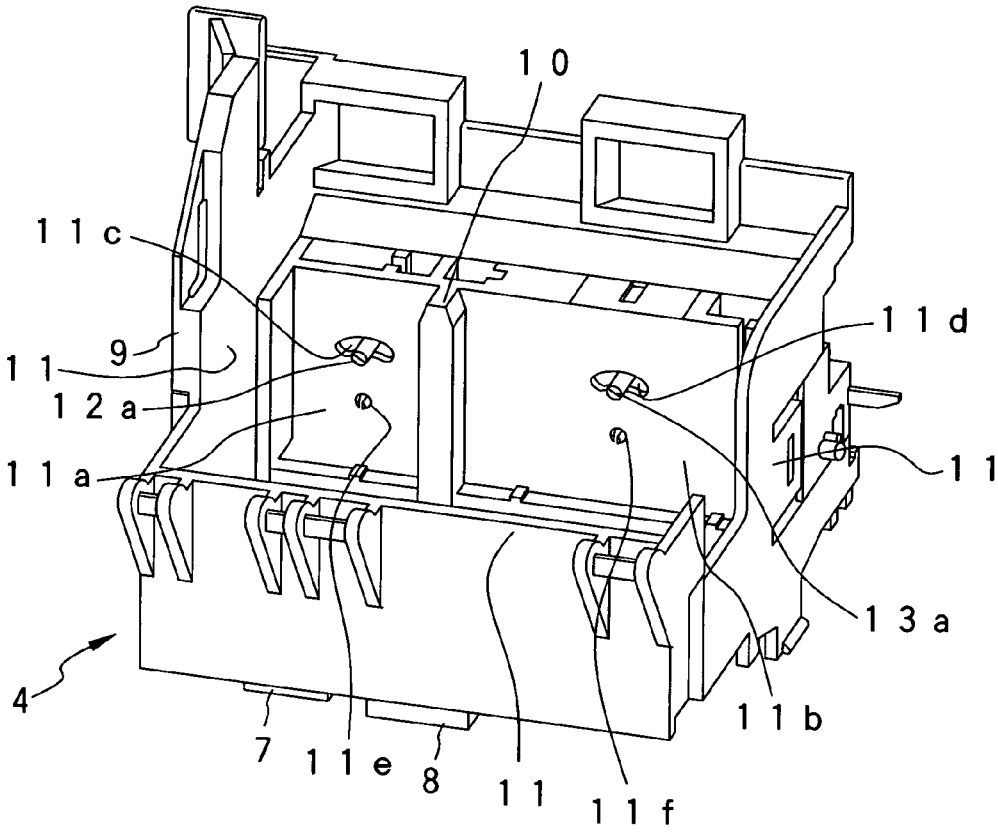
FIG. 2 is a perspective view showing the structure of a cartridge accommodation holder of a carriage which is a component of the inkjet recording apparatus of the invention.

FIG. 2 shows an embodiment of the carriage 4. In this embodiment, inkjet recording heads 7 and 8 that receive supply of inks from ink cartridges 5 and 6, respectively, are disposed on the bottom surface of the carriage 4. Vertical walls 11 form a boxlike enclosure on the upper surface of the carriage 4 to accommodate the ink cartridges 5 and 6 such that their top surfaces are exposed. In this way, a cartridge holder 9 is integrally formed.

The cartridge holder 9 is partitioned by a rib 10 into two sections to accommodate the two kinds of ink cartridges 5 and 6 in given regions. Windows 11*c* and 11*d* for forming fixing members are respectively formed at substantially central portions of the vertical walls 11*a* and 11*b* that respectively define the regions for accommodating the cartridges. Fixing protrusions 12*a* and 13*a* of fixing members 12 and 13 as described later protrude through the windows 11*c* and 11*d* into the side of the cartridge accommodation regions.

The windows 11*c* and 11*d* are formed as arc-shaped through holes which limit the movement of the fixing protrusions 12*a* and 13*a* to a certain angular range L. Mounting holes 11*e* and 11*f* are formed on the centerlines of the windows 11*c* and 11*d* and under these windows 11*c* and 11*d*.

These window 11*c*, 11*d* and fixing member 12, 13 together form a one-push type fixing member.

Figure 3A:
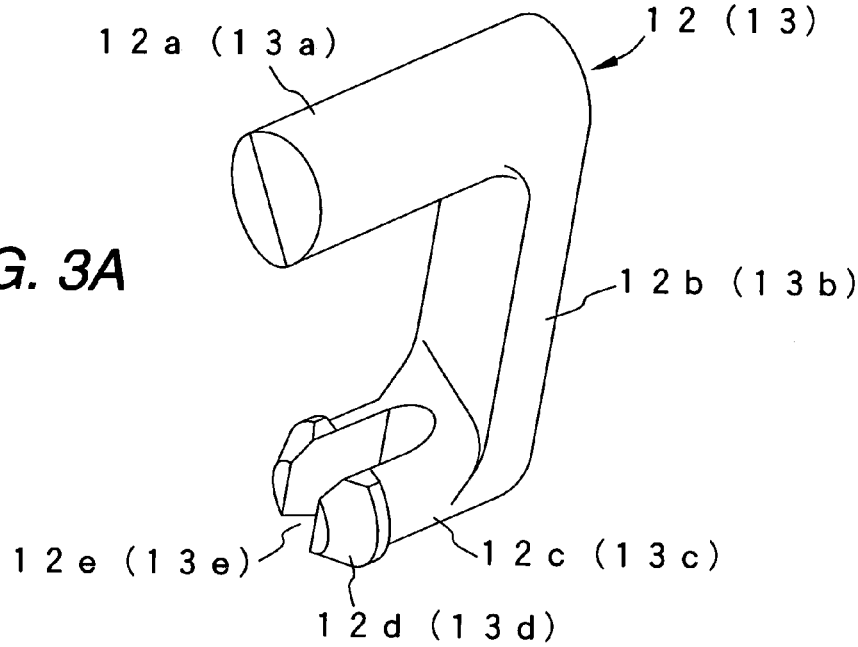
FIG. 3A is a perspective view showing an embodiment of a fixing protrusion.
Figure 3B:
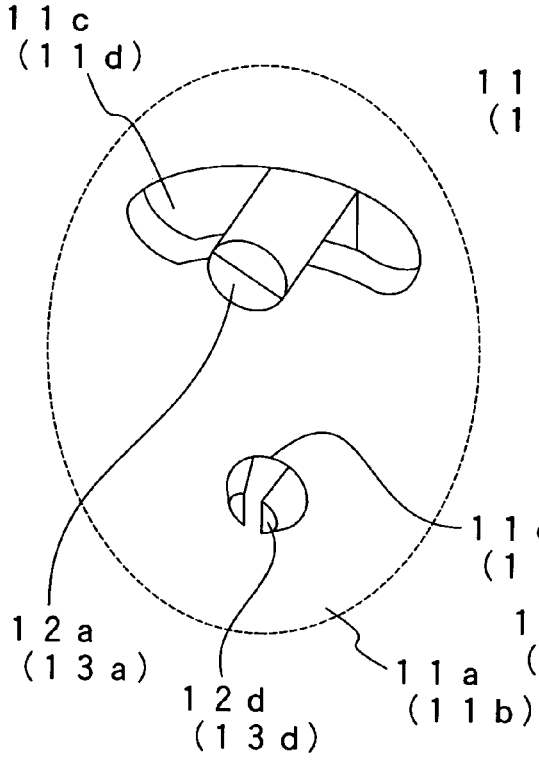
FIG. 3B is a perspective view showing a mounting state of the fixing protrusion at a front side on a vertical wall in the holder.
Figure 3C:
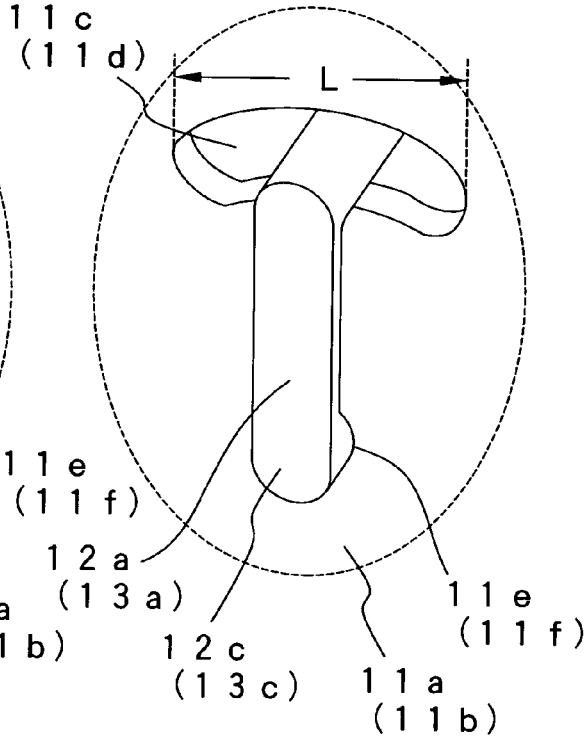
FIG. 3C is a perspective view showing the mounting state of the fixing protrusion at a rear side on the vertical wall in the holder.

FIG. 3A shows an embodiment of the fixing member 12, 13. In this embodiment, the fixing members 12 and 13 are shaped identically. The fixing members 12 (13) has an arm 12*b* (13*b*). The fixing protrusion 12*a* (13*a*) that is longer than the thickness of the vertical wall 11*a* (11*b*) but does not hinder insertion of the cartridge is formed at one end of the arm 12*b* (13*b*) perpendicularly to the longitudinal direction of the arm 12*b* (13*b*). A mounting portion 12*c* (13*c*) that is rotatably inserted into the mounting hole 11*e* (11*f*) is formed at the other end in the same direction as the fixing protrusion 12*a* (13*a*). A tapering portion 12*d* (13*d*) for preventing disconnection and a split groove 12*e* (13*e*) are formed at the front end of the mounting portion 12*c* (13*c*). The arm 12*b* (13*b*) is so designed that the position of the fixing protrusion 12*a* (13*a*) is displaceable in a direction intersecting a surface direction of a fixing member 30 described later in, conformity with recessed and protruded portions of the fixing member 30, and that the arm 12*b* (13*b*) has such an elasticity as to cause the fixing protrusion 12*a* (13*a*) to contact the fixing member 30 with a given contact force. This ensures reliable contact between the fixing protrusion 12*a* (13*a*) and the fixing member 30, to thereby eliminate failure of fixing the ink cartridge caused due to insufficient contact.

Because of this structure, when the fixing protrusion 12*a* (13*a*) of the fixing member 12 (13) is inserted into the window 11*c* (11*d*) and the tapering portion 12*d* (13*d*) of the mounting portion 12*c* (13*c*) is forced into the mounting hole 11*e* (11*f*), the mounting portion is permitted by the split groove 12*e* (13*e*) to be deformed and then rotatably fitted in the mounting hole 11*e* (11*f*)

Figure 4A:
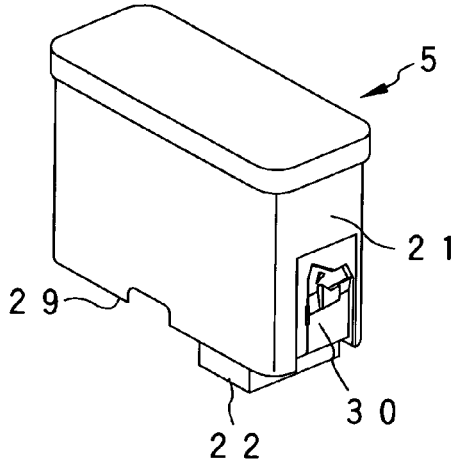
FIG. 4 is a perspective view of an embodiment of an ink cartridge adapted for the recording apparatus.
Figure 4B:
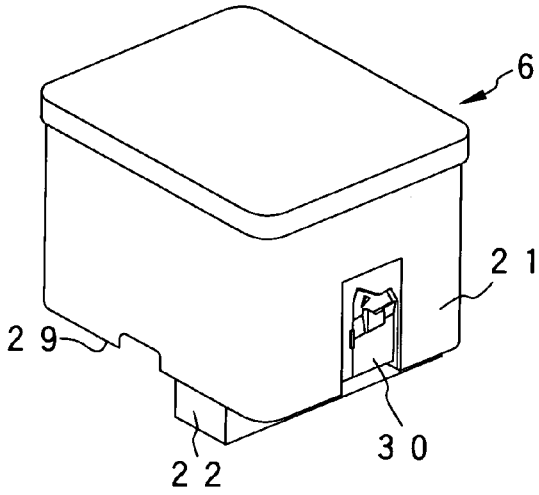

FIGS. 4A and 4B show embodiments of the ink cartridges 5 and 6 of the invention. Namely, FIG. 4A show the ink cartridge which contains one kind of ink, black ink in this embodiment, and FIG. 4B shows the ink cartridge which is formed with a plurality of separate ink storage chambers by partition walls or the like and which contains different kinds of inks, yellow, magenta and cyan in this embodiment, in respective ink storage chambers, each having an independent ink supply port.

Here, only one ink cartridge 5 is described. A fixing member 30 that guides and engages the aforementioned fixing protrusion 12*a* is formed in one wall surface 21 parallel to the direction of insertion of a container 20 that contains ink therein.

Another wall surface 29 that is perpendicular to the direction of insertion is provided with an ink supply port 22 that engages an ink supply needle 14 of the carriage to discharge the ink inside the cartridge therefrom.

In this ink cartridge, the fixing member 30 is disposed at a position offset toward the surface (the bottom surface) 29 where the ink supply port 22 is formed, i.e. at a lower portion region in the insertion direction of the ink cartridge in this embodiment, and further the ink supply port 22 is disposed at a position offset toward the wall surface (the side surface) 21 (i.e. at the right side in the figure). Consequently, the fixing member 30 can surely fix a portion of the ink cartridge in the vicinity of the ink supply port 22. This arrangement can prevent the displacement of the ink cartridge even when an external force is applied in a state in which the ink supply needle 14 is inserted into the ink supply port 22, to thereby reduce an adverse affect on the connection portion between the ink supply port 22 and the ink supply needle 14. That is, since the ink supply port 22 is located at the position offset toward the wall surface 21 where the fixing member is formed, the fixing member 30 can receive the external force to reliably provide the above-noted advantageous effect.

Figure 5:
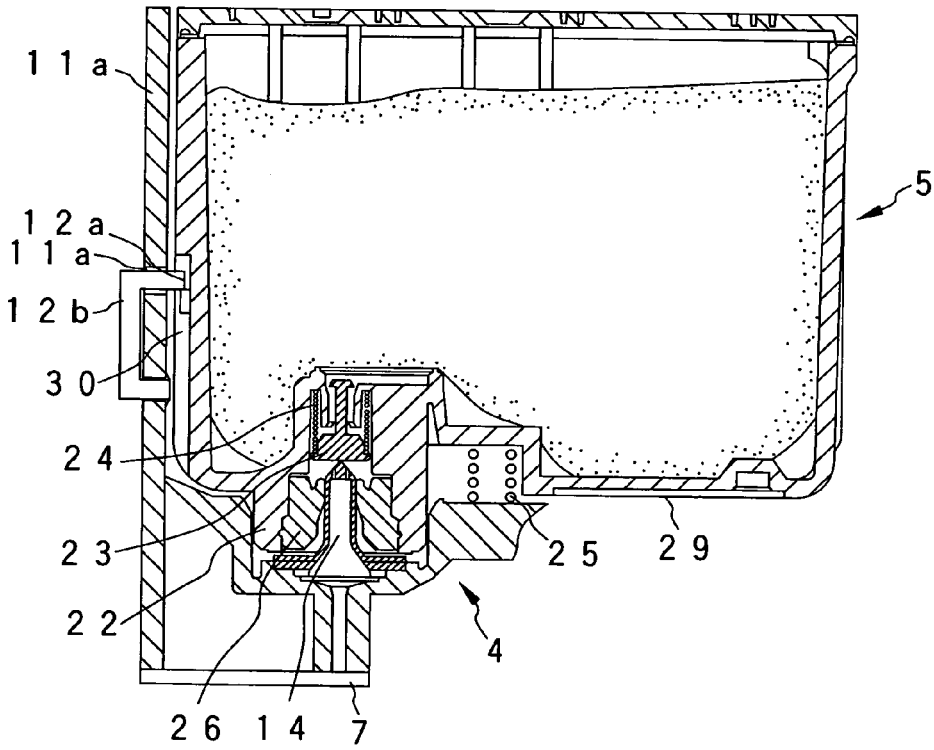
FIG. 5 is a cross-sectional view of the ink cartridge, taken through the ink supply port, and in which the cartridge is mounted the carriage.

As shown in FIG. 5, a packing 26 and a valve body 23 are loaded in the ink supply port 22 in such a way that the valve body 23 is biased by a spring 24 which is a coiled spring. The packing 26 serves as a sealing member, which closely and sealingly contacts the circumference of the ink supply needle 14. The valve body 23 contacts one end face of the packing 26 to close and seal an opening formed through the packing 26 when the cartridge is removed from the carriage, and opens the ink supply port by insertion of the ink supply needle 14 when the ink cartridge is mounted on the carriage. The extent of resilience of the spring 24 is such that even when the ink cartridge 5 is fully filled with ink and the ink supply port 22 engages the ink supply needle 14, the spring can bias the cartridge 5 in the direction opposite to the direction of insertion against the frictional force caused between the ink supply needle 14 and the packing 26.

In the aforementioned embodiment, the spring 24, provided in the ink supply port 17, for biasing the valve body 23 in the direction to close the valve body 23 is used to bias the ink cartridge in the direction opposite to the direction in which the cartridge 5 is inserted. In a case where the repulsion force of the spring 24 is small or the cartridge does not have the valve body 23 biased by the spring 24, the same advantages can be obtained by mounting a biasing spring 25 near the ink supply port 22 and in the front-end surface as viewed in the direction of insertion of the ink cartridge, (i.e., the surface in which the ink supply 22 is formed) or in the surface of the carriage 4 that faces the ink supply port 22.

Figure 6:
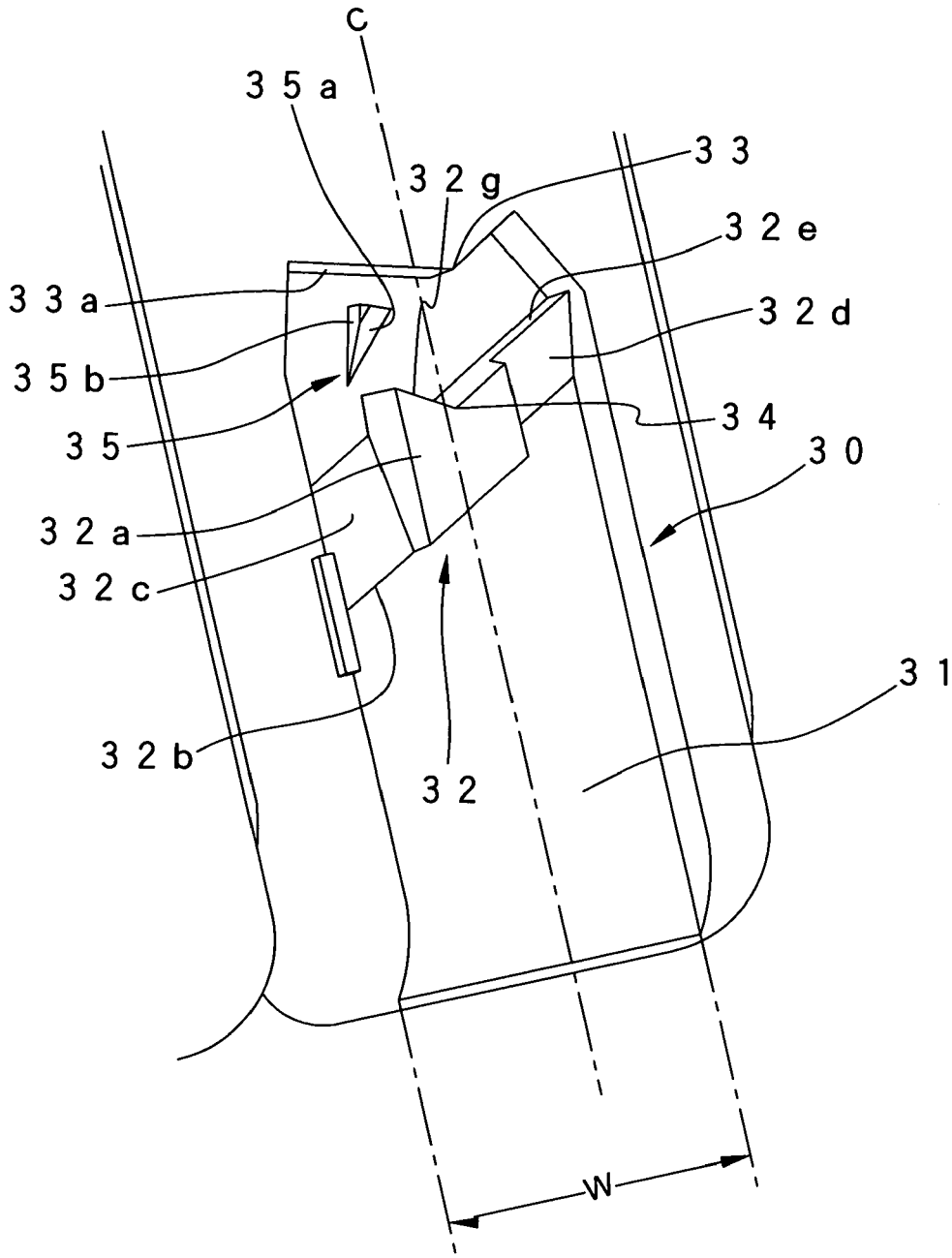
FIG. 6 is an enlarged perspective view of a fixing member formed in the ink cartridge.

FIG. 6 shows an embodiment of the fixing member 30 formed on the ink cartridge, which constitutes the one-push type fixing member. A recess portion 31 having an entrance port of, width W capable of almost covering the range of movement L of the fixing protrusion 12*a* is formed at the front end as viewed in the direction in which the cartridge is loaded (in this embodiment, in a lower portion). A guide portion 32 having an upper portion on one side is formed in the center of the recess portion 31 as viewed in the direction of insertion of the cartridge. A protruded portion 32*a* is formed in the center of the guide portion 32 such that passages through which the protrusion 12*a* can pass are formed on both sides of the protruded portion 32*a*.

In a lower portion side (the left side in the figure) relative to the protruded portion 32*a*, there are formed a vertical wall 32*b* over which the protrusion 12*a* cannot pass during the movement of the ink cartridge in the insertion direction, and an inclined surface 32*c*, above the vertical wall 32*b*, over which the protrusion 12*a* can easily pass during the movement of the ink cartridge in the removal direction.

In the other side, i.e. an upper portion side (the right side in the figure) relative to the protruded portion 32*a*, there are formed an inclined surface 32*d* over which the protrusion, 12*a* can easily pass during the movement of the ink cartridge in the insertion direction, and a vertical wall 32*e*, above the inclined surface 32*d*, over which the protrusion 12*a* cannot pass during the movement of the ink cartridge in the removal direction. This arrangement of the inclined surface 32*d* and the vertical wall 32*e* in the upper portion side is reverse to the arrangement of the vertical wall 32*b* and the inclined surface 32*c* in the lower portion side. The protrusion 12*a* enters through the inclined surface 32*d*, and exits through the inclined surface 32*c*.

An angular vertical wall 33*a*, whose vertex 33 is located slightly offset from the centerline C of the recess portion 31 toward the inclined surface 32*d*, is formed in a deeper portion of the recess portion 31 relative to the entrance side of the protrusion 12*a*. A vertical wall 32*g* obliquely upwardly extends substantially from the centerline C of the protruded portion 32*a* toward the exist side (the left side in the figure) to provide a holding portion 34 made up of a V-shaped recess portion for engagement with the protrusion 12*a*.

This holding portion 34 is disposed at a center in the width direction of the cartridge, or on a plane which passes through a central axis of the ink supply port and which is perpendicular to the wall surface, so that the holding portion 34 in cooperation with the protrusion 12*a* can reliably fix the ink cartridge 5 at a predetermined position, while causing no moment on the ink supply needle 14.

Indicated by numeral 35 in the figure is a movement direction-restricting member disposed closer to the inclined surface 32*c* than to the holding portion 34. This restricting member 35 has an inclined surface 35*a* over which the protrusion 12*a* can easily pass and a vertical wall 35*b* over which the protrusion 12*a* cannot easily pass.

Figure 7:
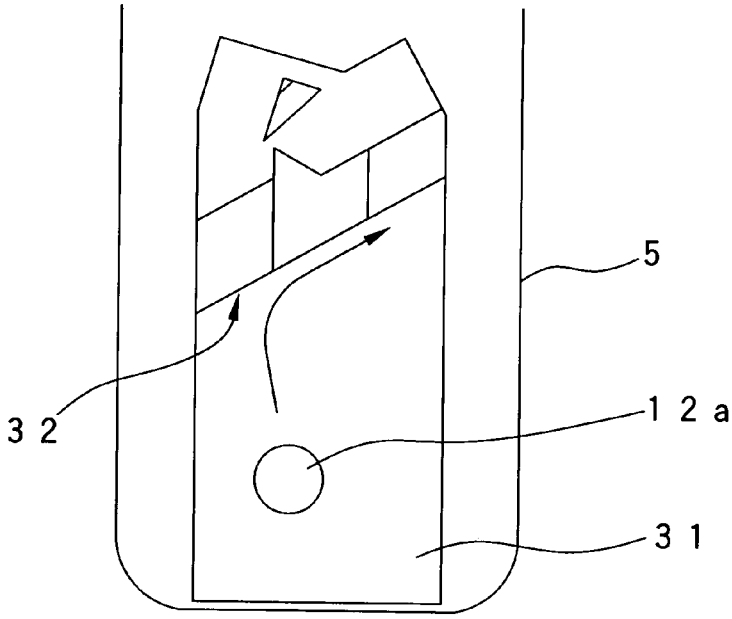
FIGS. 7I and 7II are views illustrating the former half of steps performed when the ink cartridge is mounted.
Figure 7:
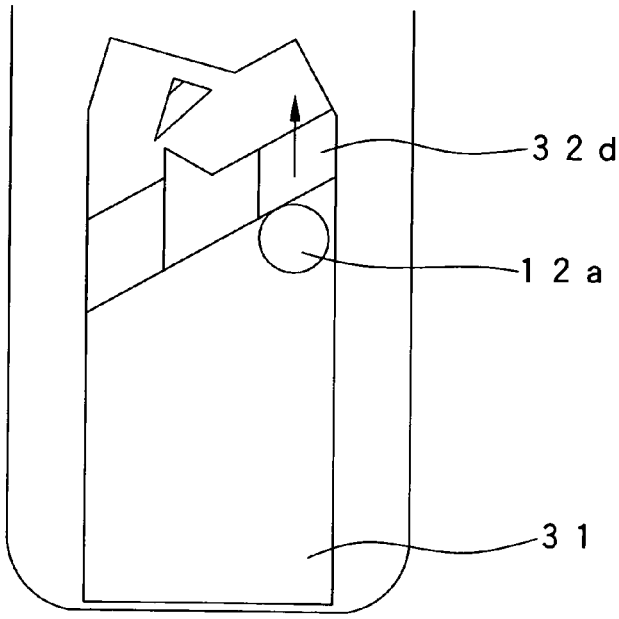

In this embodiment, when the ink cartridge 5 is inserted, the fixing protrusion 12*a* enters the opening of the recess portion 31 of the fixing member 30 and reaches the inclined surface 32*d* while being guided by the guide portion 32 (the vertical wall 32*b*) in one direction (FIG. 7I). Then, the fixing protrusion 12*a* passes over this inclined surface 32*d* (FIG. 7II).

Figure 8:
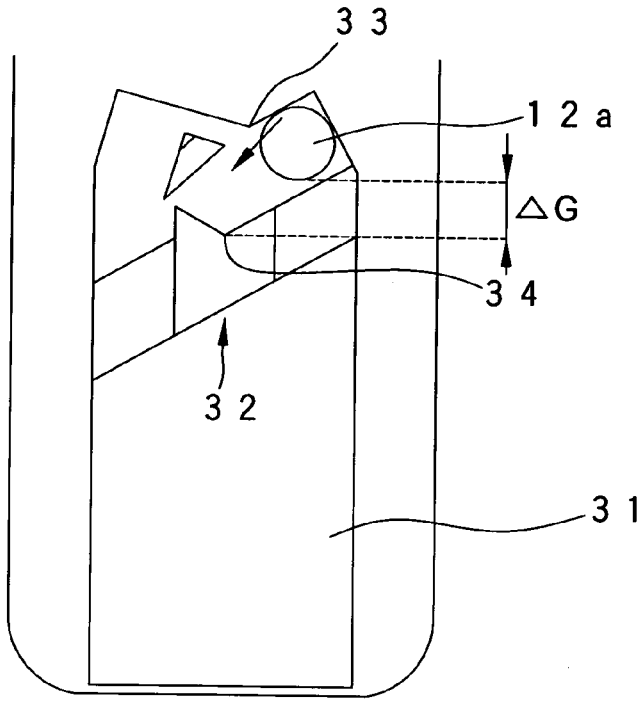
FIGS. 8I and 8II are views illustrating the latter half of the steps performed when the ink cartridge is mounted.
Figure 8:
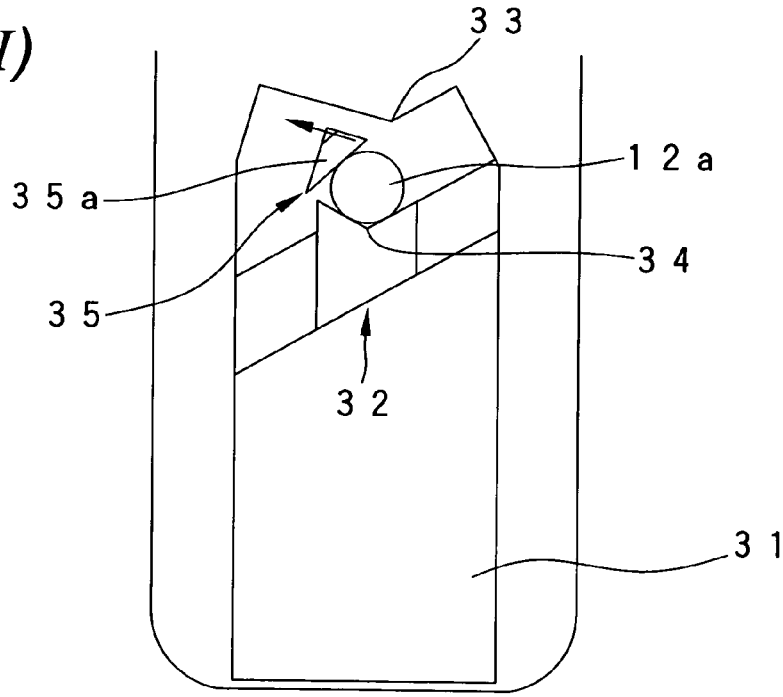

Under this condition, when the cartridge 5 is further pushed-in against the elastic force of the spring 24 of the ink supply port, the ink cartridge 5 reaches a dead point at which the fixing protrusion 12*a* contacts the angular wall 33*a* located in the deeper portion of the recess portion 31 (FIG. 8I). Under this condition, if the hand is released from the ink cartridge 5, the ink cartridge 5 is moved by a slight distance ΔG in the direction opposite to the direction of insertion by the reaction force of the spring 24 so that the fixing protrusion 12*a* is fitted into the holding portion 34, while being guided toward the centerline C by the vertical wall 32*e* (FIG. 8II).

There is a slight clearance between the dead point at the pushing-in of the ink cartridge 5 into the cartridge holder and a cartridge holding position. For this reason, when the ink cartridge is moved from the dead point at the pushing in to the cartridge holding position, the packing 26 is moved in the contracting direction due to the friction to the ink supply needle 14, so that the packing 26 reliably contacts the circumference of the ink supply needle 14 elastically, to thereby ensure air-tightness.

In addition, such clearance can be determined by the diameter of the fixing protrusion 12*a*, the position of the holding portion 34, or the like.

Figure 9:
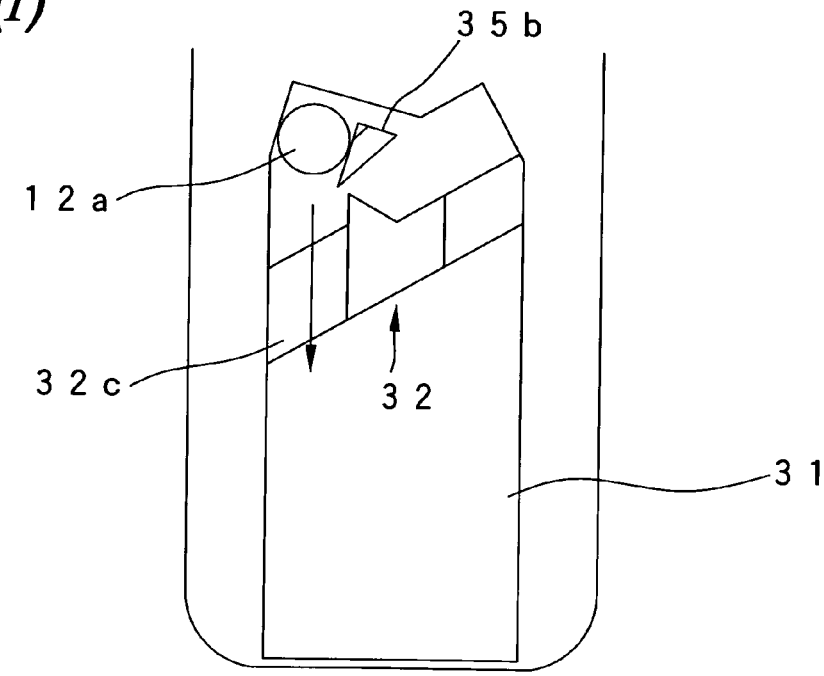
FIGS. 9I and 9II are views illustrating steps for taking out the ink cartridge.
Figure 9:
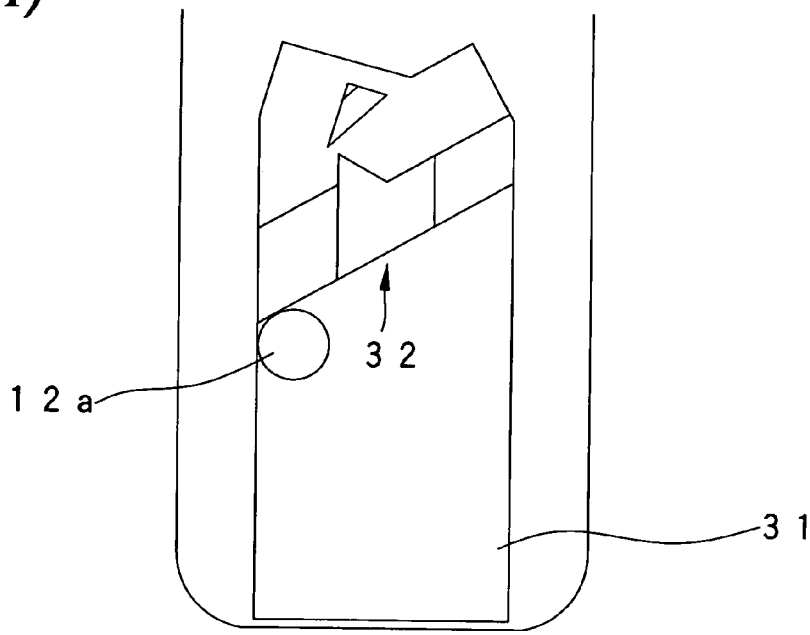
Figure 10:
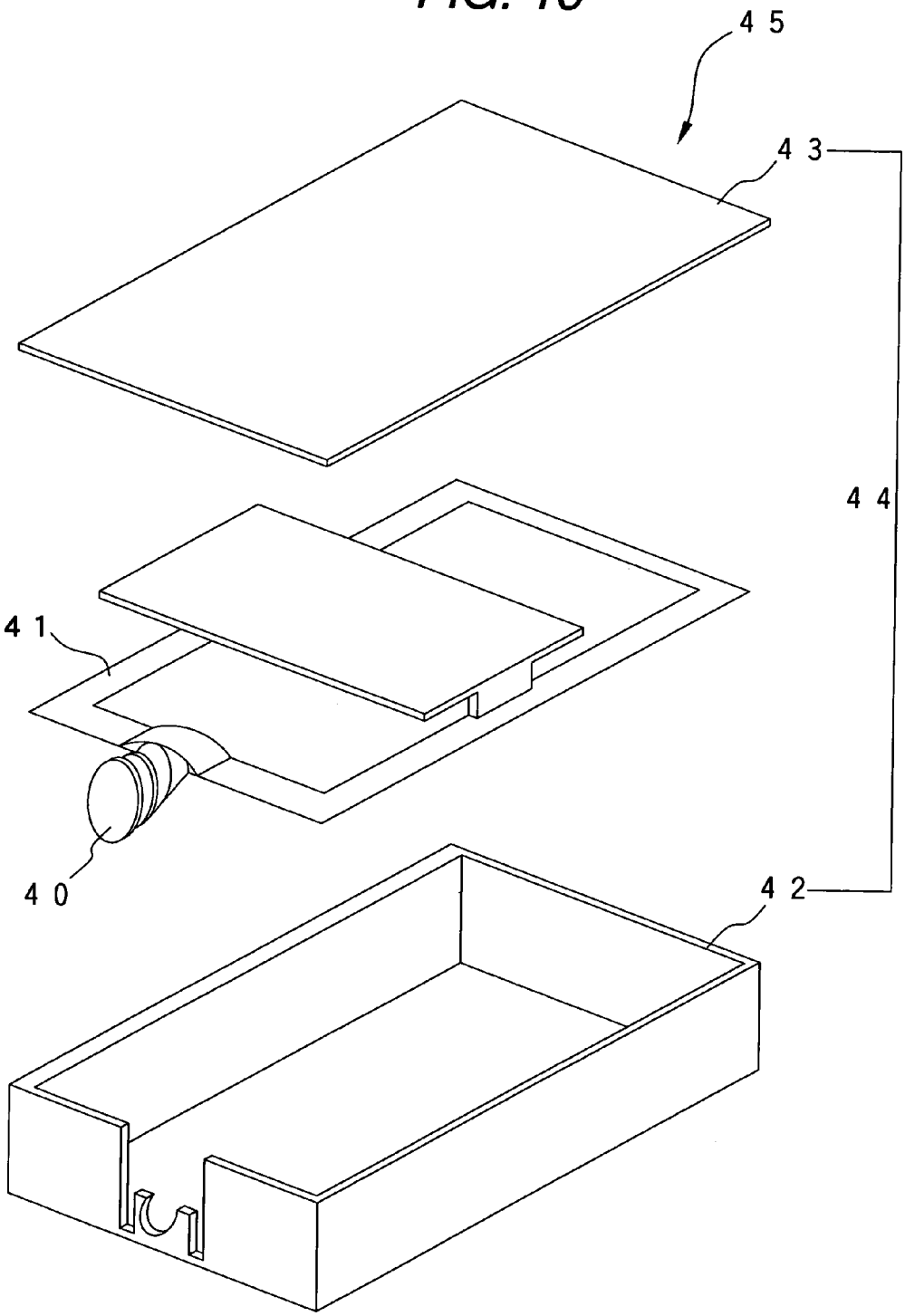
FIG. 10 is an exploded perspective view showing another embodiment of the ink cartridge to which the invention can be applied.
Figure 11:
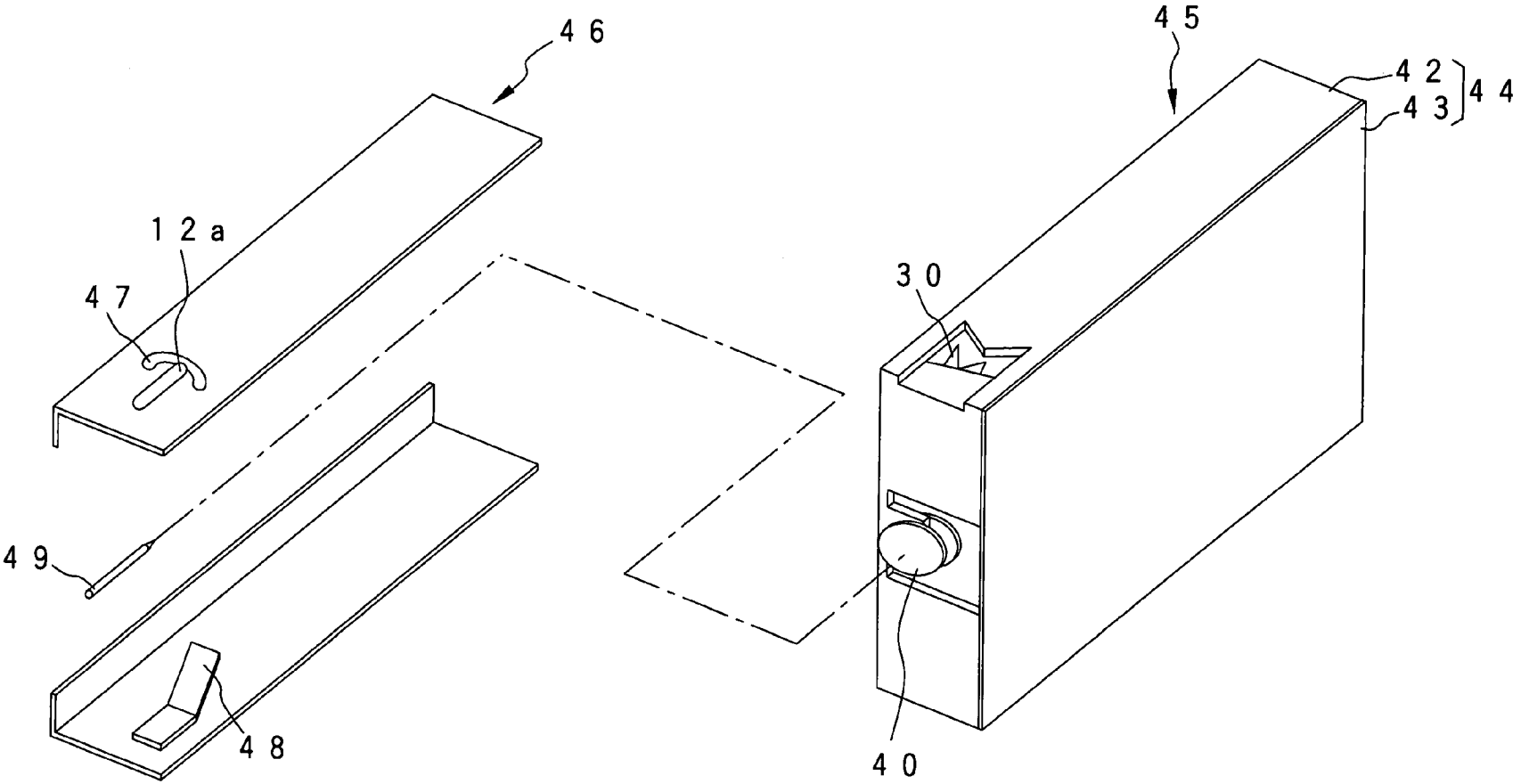
FIG. 11 is a view showing an embodiment of a cartridge holder adapted for the ink cartridge.

On the other hand, in a case where the ink in the ink cartridge has been consumed and the ink cartridge 5 is replaced, the cartridge 5 is pushed-in against the reaction force of the spring 24. The fixing protrusion 12*a* passes over the inclined surface 35*a* of the movement-restricting member 35, while being guided by the angular wall 33*a* located in the deeper portion of the recess portion 31 (FIG. 9I). The amount of the movement during this pushing-in corresponds to the aforementioned slight clearance between the dead point at the pushing-in and the cartridge holding position. By this movement, the packing 26 is relatively moved with respect to the ink supply needle 14 so that ink flows in therebetween. The ink serves as lubricant to reduce the friction during the removal.

Under this condition, if the hand is released from the cartridge 5, the reaction force of the spring 24 elevates the cartridge 5. During this process, the fixing protrusion 12*a* passes over the inclined surface 32*c* to be free from the restriction (FIG. 9II)

When a new cartridge 5 is loaded into a given position and then pushed-in, the ink cartridge can be fixed into a predetermined position in the same way as the foregoing.

In the embodiment described above, a recording apparatus of the type where the cartridge holder is mounted to the carriage has been described. It is apparent that similar advantages can be produced when the invention is applied to a type of the recording apparatus in which the cartridge is installed on the case body 1 forming the recording apparatus and ink is supplied to the recording head by the use of an ink supply tube.

That is, in a case of an ink cartridge 45 in which a flexible bag 41 containing ink therein and having an ink supply port 40 on one side thereof is accommodated in a hard case 44 made up of a case body 42 and a cover 43 in such a way that the ink supply port 40 is exposed, the aforementioned one-push type fixing member 30 is formed on a side surface of the hard case 44 such that the front side as viewed in the direction of insertion becomes an opening portion.

On the other hand, the other one-push type fixing member is formed such that the fixing protrusion 12*a* is protruded from the rotational range limiting window 47 at the side of the ink cartridge accommodating holder 46 to be opposed to the fixing member 30. A resilient member 48 is disposed on the side of an ink supply needle 49. In this way, the cartridge 45 can be fixed into a predetermined position simply by pushing it in. When the ink cartridge 45 is removed, the ink cartridge 45 is pushed in against the resilient member 48. In this way, the ink cartridge 45 can be taken out.

This embodiment can also employ, in place of the resilient member 48, a valve arrangement having the valve body 23 installed in the ink supply port 22 and the spring 24 for biasing the valve body 23 toward the ink supply port side as discussed with reference to FIG. 5, in order to produce the same effect using the elastic of the spring for biasing the valve body.

Figure 12:
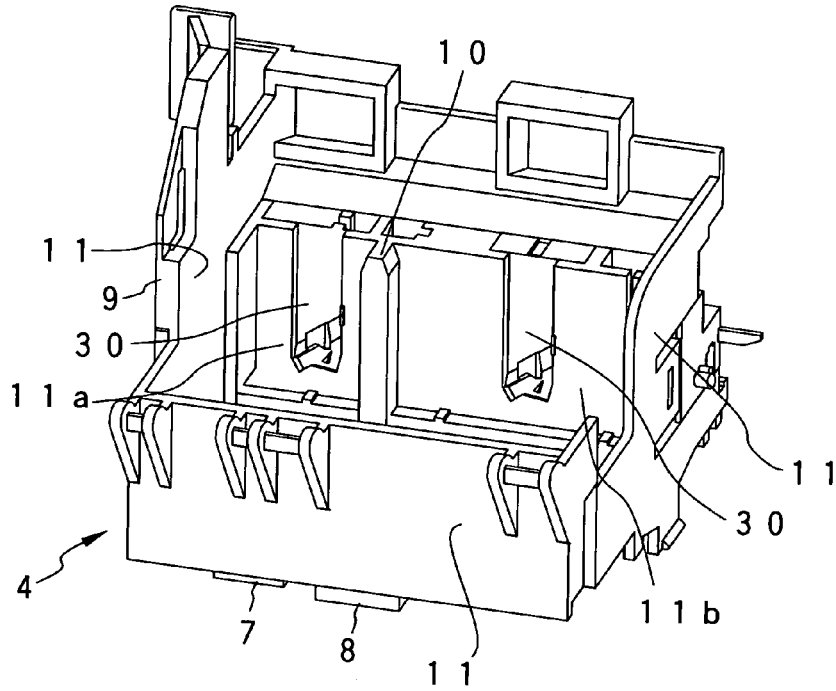
FIG. 12 is a perspective view in which another embodiment of the recording apparatus of the invention is shown by the structure of a cartridge accommodation region.
Figure 13A:
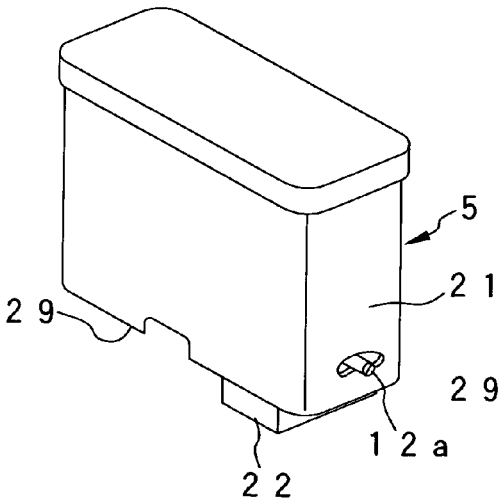
FIGS. 13A and 13B are perspective views, each showing another embodiment of the ink cartridge of the invention.
Figure 13B:
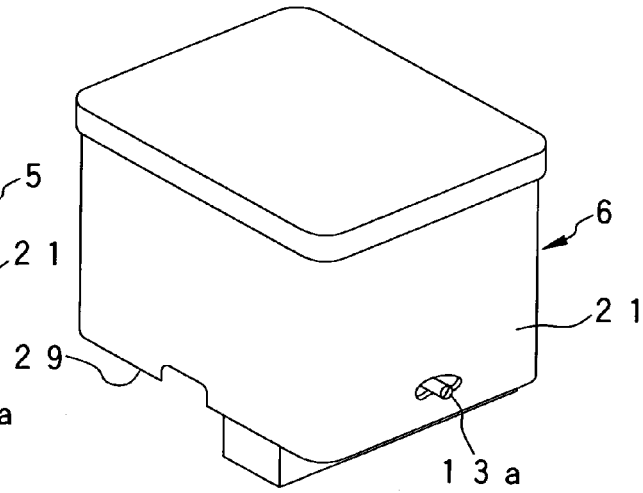

In the embodiment described above, a one-push type fixing member for receiving a fixing protrusion and another one-push type fixing member having the fixing protrusion are formed on the ink cartridge and cartridge holder, respectively. It is apparent that, the same advantages can be obtained when one push type fixing member 30 for receiving the fixing protrusion is arranged on the cartridge holder 9 and another one-push type fixing member having the fixing protrusion 12*a*, 13*a* is arranged on the ink cartridge 5, 6 as shown in FIGS. 12 and 13.

What is claimed is:

1. An inkjet recording apparatus having a recording head that receives supply of ink from an ink cartridge installed in a cartridge accommodation region, the ink cartridge having a first member constituting a one-push type fixing member formed on the ink cartridge, the inkjet recording apparatus comprising:

a second member that constitutes another one-push type fixing member cooperating with the first member, and that is formed in a position facing a plane that is substantially parallel to an insertion direction in which the ink cartridge is inserted into the cartridge accommodation region, whereby the ink cartridge is held by the first and members in a predetermined position in a state in which the ink cartridge is resiliently urged by a resiliently urging member in a direction opposite to the insertion direction, wherein the first member constituting the one-push type fixing member includes a protrusion whose range of motion is restricted, and wherein the second member includes a combination of a guide path for guiding the protrusion in one direction, and a holding portion engaging the protrusion.

2. An inkjet recording apparatus having a recording head that receives supply of ink from an ink cartridge installed in a cartridge accommodation region, the ink cartridge having a first member constituting a one-push type fixing member formed on the ink cartridge, the inkjet recording apparatus comprising:

a second member that constitutes another one-push type fixing member cooperating with the first member, and that is formed in a position facing a plane that is substantially parallel to an insertion direction in which the ink cartridge is inserted into the cartridge accommodation region, whereby the ink cartridge is held by the first and members in a predetermined position in a state in which the ink cartridge is resiliently urged by a resiliently urging member in a direction opposite to the insertion direction, wherein the first member constituting the one-push type fixing member includes a combination of a guide path for guiding the protrusion in one direction, and a holding portion engaging the protrusion, and wherein the second member includes a protrusion whose range of motion is restricted.

3. The inkjet recording apparatus as set forth in claim 1 or claim 2, wherein the resiliently urging member includes a spring that biases a valve body loaded in an ink supply port.

4. The inkjet recording apparatus as set forth in claim 1 or claim 2, wherein the resiliently urging member includes a spring disposed in the ink cartridge accommodation region or a spring disposed on an outer surface of a container of the ink cartridge.

5. The inkjet recording apparatus as set forth in claim 1 or claim 2, wherein a position of the holding portion or a diameter of the protrusion is selected to define a clearance between a dead point at pushing-in of the ink cartridge and the predetermined position.

6. An ink cartridge having an ink storing portion storing ink therein and an ink supply port communicating with the ink storing portion, the ink cartridge being adapted to removably mounted on a cartridge mounting portion of a recording apparatus to supply the ink in the ink storing portion via the ink supply port to a recording head provided on the recording apparatus, the ink cartridge comprising:

a first member that constitutes a one-push type fixing member, that is formed on a plane substantially parallel to an insertion direction in which the ink cartridge is inserted into the cartridge mounting portion, and that cooperates with a second member constituting another one-push type fixing member of the recording apparatus, wherein the second member includes a protrusion whose range of motion is restricted, and the first member includes a combination of a guide path for guiding the protrusion in one direction, and a holding portion engaging the protrusion.

7. An ink cartridge having an ink storing portion storing ink therein and an ink supply port communicating with the ink storing portion, the ink cartridge being adapted to removably mounted on a cartridge mounting portion of a recording apparatus to supply the ink in the ink storing portion via the ink supply port to a recording head provided on the recording apparatus, the ink cartridge comprising:

a first member that constitutes a one-push type fixing member, that is formed on a plane substantially parallel to an insertion direction in which the ink cartridge is inserted into the cartridge mounting portion, and that cooperates with a second member constituting another one-push type fixing member of the recording apparatus, wherein the second member includes a combination of a guide path for guiding a protrusion in one direction, and a holding portion engaging the protrusion, and the first member includes the protrusion whose range of motion is restricted and which is engageable with the second member.

8. The ink cartridge as set forth in claim 6 or 7, further comprising a resiliently urging member for resiliently urging the ink cartridge in a direction opposite to the insertion direction.

9. The ink cartridge as set forth in claim 8, wherein the resiliently urging member includes a spring that biases a valve member loaded in the ink supply port.

10. The ink cartridge set forth in claim 8, wherein the resiliently urging member includes a spring mounted on a container wall surface of the ink cartridge.

11. The ink cartridge as set forth in claim 6 or 7, wherein the first member is disposed on a wall surface intersecting a wall surface on which the ink supply port is disposed, and located at a position offset toward the wall surface on which the ink supply port is disposed.

12. The ink cartridge as set forth in claim 11, wherein the ink supply port is located at a position offset toward the wall surface on which the first member is disposed.

13. The ink cartridge as set forth in claim 6 or 7, wherein the protrusion whose range of motion is restricted is movable in a plane direction of the plane substantially parallel to the insertion direction, and also movable in a direction intersecting the plane.

14. The ink cartridge as set forth in claim 6 or 7, wherein the holding portion of the first member is resiliently held by the protrusion by an urging force of a resiliently urging member.

15. The ink cartridge as set forth in claim 6 or 7, wherein a position of the holding portion or a diameter of the protrusion is selected to define a clearance between a dead point at pushing-in of the ink cartridge and the predetermined position.

16. The ink cartridge as set forth in claim 6 or 7, wherein the holding portion engages the protrusion to hold the ink cartridge in a first predetermined position in a state in which the ink cartridge is urged by an urging member in a direction opposite to the insertion direction.

17. The ink cartridge as set forth in claim 16, wherein the urging member is disposed on the cartridge mounting portion, and the ink cartridge is configured to be urged by the urging member of the cartridge mounting portion when the ink cartridge is inserted, into the cartridge mounting portion.

18. The ink cartridge as set forth in claim 17, wherein engagement between the holding portion and the protrusion is established when the ink cartridge is inserted into the cartridge mounting portion to reach, beyond the first predetermined position, a second predetermined position in the insertion direction against an urging force of the urging member, and then is returned by the urging force of the urging member to the first predetermined position.

19. The ink cartridge as set forth in claim 18, wherein engagement between the holding portion and the protrusion is released when the ink cartridge inserted and held at the first predetermined position is further inserted into the cartridge mounting portion against the urging force of the urging member to reach a third predetermined position.

* * * * *